US007543654B2

(12) United States Patent
Koiwa

(10) Patent No.: US 7,543,654 B2
(45) Date of Patent: Jun. 9, 2009

(54) SPRINKLER HEAD COVER AND A SPRINKLER HEAD

(75) Inventor: Yasuaki Koiwa, Ichinoseki (JP)

(73) Assignee: Senju Sprinkler Co., Ltd., Tokyo (JP)

( * ) Notice: Subject to any disclaimer, the term of this patent is extended or adjusted under 35 U.S.C. 154(b) by 249 days.

(21) Appl. No.: 10/594,512

(22) PCT Filed: Mar. 16, 2005

(86) PCT No.: PCT/JP2005/004610

§ 371 (c)(1),
(2), (4) Date: Sep. 28, 2006

(87) PCT Pub. No.: WO2005/097265

PCT Pub. Date: Oct. 20, 2005

(65) Prior Publication Data

US 2007/0215720 A1 Sep. 20, 2007

(30) Foreign Application Priority Data

Mar. 30, 2004 (JP) ..... 2004-100824

(51) Int. Cl.

| | |
|---|---|
| ***A62C 37/36*** | (2006.01) |
| ***A62C 37/08*** | (2006.01) |
| ***A62C 3/00*** | (2006.01) |
| ***B05B 1/28*** | (2006.01) |
| ***B05B 15/04*** | (2006.01) |

(52) U.S. Cl. ..... 169/42; 169/37; 169/41; 169/54; 239/288.5

(58) Field of Classification Search ..... 169/38, 169/41, 42, 56, 57, 37, 54; 239/201, 208, 239/209, 288.5

See application file for complete search history.

(56) References Cited

U.S. PATENT DOCUMENTS

| | | | | |
|---|---|---|---|---|
| 4,880,063 | A | 11/1989 | Leininger et al. | |
| 5,072,792 | A * | 12/1991 | Simons et al. | 169/37 |
| 5,083,616 | A * | 1/1992 | Polan | 169/40 |
| 5,152,344 | A * | 10/1992 | Fischer et al. | 169/37 |
| 5,372,203 | A * | 12/1994 | Galaszewski | 169/37 |
| 6,082,463 | A * | 7/2000 | Ponte | 169/41 |

(Continued)

FOREIGN PATENT DOCUMENTS

| | | |
|---|---|---|
| JP | 3016985 | 8/1995 |

(Continued)

*Primary Examiner*—Len Tran
*Assistant Examiner*—Ryan Reis
(74) *Attorney, Agent, or Firm*—Wenderoth, Lind & Ponack, L.L.P.

(57) ABSTRACT

A sprinkler head cover including a housing adapted to be attached to a sprinkler head which is connected to a water supply piping and in which, in the case of fire, a valve disposed inside the sprinkler head is opened to allow a fire-extinguishing liquid in the water supply piping to be dispersed. A cover plate is adapted to cover the sprinkler head so that the sprinkler head cannot be seen from outside, and a mount is installed in the housing and has a hole inside thereof. The cover plate and the mount are connected to each other by a low melting point alloy melted out from the hole, and a heat collector of the sprinkler head has a structure for allowing the heat collector to come into contact with the cover plate.

5 Claims, 10 Drawing Sheets

U.S. PATENT DOCUMENTS

| | | | | |
|---|---|---|---|---|
| 6,374,919 | B1 * | 4/2002 | Neill | 169/37 |
| 6,805,203 | B2 | 10/2004 | Retzloff et al. | |
| 6,840,329 | B2 * | 1/2005 | Kikuchi et al. | 169/37 |

FOREIGN PATENT DOCUMENTS

| | | |
|---|---|---|
| JP | 3016985 | 10/1995 |
| JP | 7-303713 | 11/1995 |
| JP | 2000-37473 | 2/2000 |
| JP | 2002-200189 | 7/2002 |
| JP | 2003-38677 | 2/2003 |
| JP | 2003-205049 | 7/2003 |
| JP | 2003-210606 | 7/2003 |
| JP | 2003-265642 | 9/2003 |
| JP | 2003-325695 | 11/2003 |

* cited by examiner

SPRINKLER HEAD COVER AND A SPRINKLER HEAD

BACKGROUND OF THE INVENTION

1. Technical Field of the Invention

The present invention relates to a sprinkler head to be installed in a building and actuated in case of fire to spread a fire-extinguishing liquid. The present invention also relates to a sprinkler head cover to be installed in the same sprinkler head.

2. Description of Related Art

A sprinkler head installed in a ceiling or a wall of a building interior is coupled to a water supply piping, in which a nozzle is closed by a valve within the sprinkler head. The valve is supported by a heat-sensitive operating section in which is incorporated a heat-sensitive element, and in operation, the heat-sensitive element can sense the heat from fire and trigger the heat-sensitive operating section to be actuated for opening the valve.

When the valve is open, a fire-extinguishing liquid within the nozzle is released, and the fire-extinguishing liquid would impinge upon a deflector disposed ahead of the nozzle and then spread all around to mitigate or extinguish fire.

In connection with the sprinkler head, a sprinkler head cover has been provided in order to cover the sprinkler head because the sprinkler head is not desirable from the viewpoint of design.

The sprinkler head cover comprises a housing attached externally to the sprinkler head and a cover plate for covering the sprinkler head, both of which are connected to each other by means of a low melting point alloy.

In case of fire, hot air stream from flames and smoke as well as heat absorbed by the cover plate of the sprinkler head cover would melt the low melting point alloy to thereby disengage the cover plate from the housing to permit the cover plate to drop down.

Subsequently, the sprinkler head disposed inside the housing would be actuated with heat from the fire so as to spread the fire-extinguishing liquid.

The sprinkler head provided with the sprinkler head cover includes, for example, one having a disc-like cover plate (see, for example, U.S. Pat. No. 5,372,203) and another having a bowl-like cover plate (see, for example, U.S. Pat. No. 5,072,792).

SUMMARY OF THE INVENTION

Although the sprinkler head provided with the sprinkler head cover as disclosed in U.S. Pat. No. 5,372,203 is superior in exterior design because the disc-like cover plate is installed in the sprinkler head and this can help reduce a volume of protrusion from a ceiling surface. A disadvantage of this design is that it may be difficult for the hot air stream from the fire to reach the sprinkler head disposed deep inside the housing after the disengagement of the cover plate under the fire, requiring a long time to trigger the sprinkler head to be actuated.

In addition, the sprinkler head provided with the sprinkler head cover, disclosed in U.S. Pat. No. 5,072,792, represents the one with the bowl-like cover plate installed therein, in which, in case of fire, the dropping off of the cover plate through its own actuation and subsequent actuation of the sprinkler head could take place quicker than in the sprinkler head disclosed in U.S. Pat. No. 5,372,203.

However, due to a shape of the cover plate that has employed the bowl-like configuration, a site of connection between the cover plate and the housing necessarily defines an inclined-face and the inclined-face should allow the molten low melting point alloy to flow down along the inclined surface of the cover plate during soldering work, thus making it problematic to carry out the soldering work, which could lead to a variation in connection strength depending on the specific skill of the worker.

If a quantity of the low melting point alloy is insufficient or a connection area is not large enough in the site of connection between the cover plate and the housing, the connection strength would be consequently low. In this condition, if an external force is applied to the cover plate, possibly the low melting point alloy could be cracked away from the cover plate or the cover plate could be removed and could fall down.

The present invention has been made in the light of the problems described above, and an object thereof is to provide a sprinkler head cover and a sprinkler head, which can be actuated quickly in case of fire and in which the constant connection strength is accomplished between the cover plate and the housing without any variations in connection strength exhibited therebetween.

To accomplish the object of the present invention as described above, the inventors of the present invention have conducted research directed to a distance from the ceiling surface to the cover plate in order to absorb the heat efficiently from the hot air stream drifting in a level below the ceiling surface so as to accelerate the melting of the low melting point alloy in the case of fire and have finally completed the present invention.

The temperature of the hot air stream drifting below the ceiling surface is the highest at a level of some millimeters to some tens of millimeters below the ceiling surface but not immediately below the ceiling surface, and the temperature tends to decrease as the distance to the ceiling surface increases.

It has been apparent from the research based on this knowledge that the heat can be absorbed efficiently from the hot air stream with the cover plate being installed at the level of some millimeters to some tens of millimeters below the ceiling surface as pointed out above.

On the other hand, the inventors have also considered the type of sprinkler head housed in the sprinkler head cover that the heat can easily transfer to the sprinkler head even in a condition of the sprinkler head cover installed in the sprinkler head so that the sprinkler head can be actuated quickly in case of fire.

In addition, with regard to a structure at the site of connection between the housing and the cover plate, the inventors have also contemplated such a structure that can achieve resultantly the satisfactory connection strength between the housing and the cover plate, even if the cover plate employs a configuration of a curved surface.

The present invention provides a sprinkler head cover comprising: a housing adapted to be attached to be attached to a sprinkler head which is connected to a water supply piping and in which, in case of fire, a valve disposed inside the sprinkler head is open to allow a fire-extinguishing liquid in the water supply piping to spread around; a cover plate adapted to cover the sprinkler head so that the sprinkler head cannot be seen from outside; and a mount installed in the housing and having a hole inside thereof, in which a cover plate connecting surface of the mount has a flange configuration wherein the cover plate and the mount are connected to each other by solidifying a molten low melting point alloy after its having flowed out from the hole to the cover plate side.

A further aspect of the invention is that the sprinkler head cover has a curved surface configuration and the cover plate connecting surface of the mount defines an inclined-face to be placed in contact with the curved surface of the cover plate.

A further aspect of the invention is an aligning means that is disposed in the cover plate connecting surface of the mount.

Also, the cover plate and the mount are made of a member having an excellent thermal conductivity and the housing is made of heat insulating material.

A further aspect of the invention is that a leaf spring, which is folded in three, is disposed between the housing and the inclined-face portion of the cover plate and a cuff is disposed in an end of a housing contact surface of the leaf spring. The cuff portion is locked in a cut defined in a peripheral edge of the housing.

A further aspect of the invention is that the housing of the sprinkler head cover, as described above, can be mounted on the sprinkler head and a heat collector to be connected with a heat sensitive element disposed in a lower portion of the sprinkler head is allowed to come in contact with the cover plate. The heat collector comprises a plurality of plate-like heat collectors disposed in layers and one heat collector placed on the bottom layer is made of resilient material and has a plurality of vanes protruding radially in a diagonally downward direction.

Further, due to the mount that has been employed for the connection between the housing and the cover plate in the sprinkler head cover, the level at which the cover plate is installed can be set to a suitable level to facilitate the absorption of the hot air stream below the ceiling surface, as the mount can serve as a spacer.

In addition, in a manufacturing process, in the housing in which the mount has been already installed, when the housing is placed on the cover plate after a piece of low melting point alloy having been placed into the mount and then heated in a furnace, the low melting point alloy piece would melt. As this molten alloy is cooled, the cover plate and the mount are connected to each other.

According to the above described process, it becomes possible to produce a large number of the sprinkler head covers at one time, and it also becomes possible to manufacture a product having constant quality by controlling the quantity of the low melting point alloy pieces, the temperature in the furnace, the cooling time and the like.

In addition, owing to the cover plate connecting surface of the mount employing the flange configuration, there would be an effect to be brought about in that the flange surface and the cover plate can be soldered together by the low melting point alloy, so that the resultant connection area would be larger and consequently the connection strength would be greater.

Further, if the gap is provided between the cover plate connecting surface of the mount and the cover plate, there would be an action to be observed, that of the low melting point alloy, once melted, can flow into the gap under the capillary phenomenon. In addition, surface tension of the molten low melting point alloy causes the low melting point alloy to adhere to an outer peripheral surface of the cover plate connecting surface, so that the outer peripheral surface of the cover plate connecting surface and the cover plate can be connected in a three-dimensional configuration and thus the connection strength can be improved.

Further, due to the cover plate having the curved surface configuration, there would be an effect to be brought about in that the cover plate is not likely to be deformed when subjected to an external force. Further, in order to obtain a sufficient connection strength between the mount and the cover plate, the cover plate connecting surface of the mount defines the inclined-face to be placed in contact with the curved surface of the cover plate.

Since the cover plate connecting surface of the mount does not define a horizontal plane but is formed into an inclined surface when the cover plate has the curved surface configuration, the aligning means is disposed in the cover plate connecting surface so that the mount can be installed in the housing in a position where the cover plate connecting surface formed into the inclined-face along its full circumference can be placed in contact with the cover plate.

The housing is made of a heat insulating material so that the heat absorbed by the cover plate and the mount can be consumed exclusively to melt the low melting point alloy.

On the other hand, the through hole is formed through the flange defined in the lower portion of the housing instead of using the mount as described above, in which a piece of the low melting point alloy is placed in the through hole and heated in the furnace to allow the connection between the housing and the cover plate to be also accomplished.

Further, if the coating film comprising the material having an excellent adhesion to the low melting point alloy being applied to the cover plate connecting surface of the housing, it becomes possible to prevent, after the housing having been connected with the cover plate, the housing from being separated from the low melting point alloy, resulting in the lower connection strength.

The leaf spring is disposed in order to facilitate the separation of the cover plate from the mount to allow the cover plate to drop off in the case of fire, and the leaf spring that is folded in three, can help increase an actuation stroke to be greater than that achieved by the spring folded in two.

Especially, in a case of the cover plate defining the curved surface, since the curved surface of the cover plate, which the leaf spring is placed in contact with, is not extending in parallel with the housing bottom surface, making the actuation stroke greater by employing the leaf spring folded in three is more advantageous to obtain the actuation stroke sufficient to separate the cover plate from the mount upon melting of the low melting point alloy.

In addition, with the aid of the cuff (pawl) disposed in the end of the housing contact surface of the leaf spring, which is adapted to engage with the peripheral edge of the housing, the leaf spring can be prevented from slipping into the inside of the cover plate or out of the housing, so that the leaf spring can be always held in an appropriate position.

Also, a structure is provided, in which the heat can be transferred to the heat sensitive element via the heat collector placed in contact with the cover plate even in a condition where the sprinkler head is covered with the cover plate.

Further, in this structure, one heat collector placed on the bottom layer has employed a plurality of vanes protruding radially in the diagonally downward direction, in which the vanes of the heat collector extend substantially in the horizontal direction under the condition where the cover plate is installed but when the cover plate has dropped off. The vanes of the heat collector can be restored to their original configuration where they protrude in the diagonally downward direction favorably for absorbing the heat from the hot air stream drifting below the ceiling surface.

DETAILED DESCRIPTION OF THE INVENTION

A first embodiment and a second embodiment will be illustrated below for an exemplary mode for carrying out the present invention.

Embodiment 1

Figure 1:
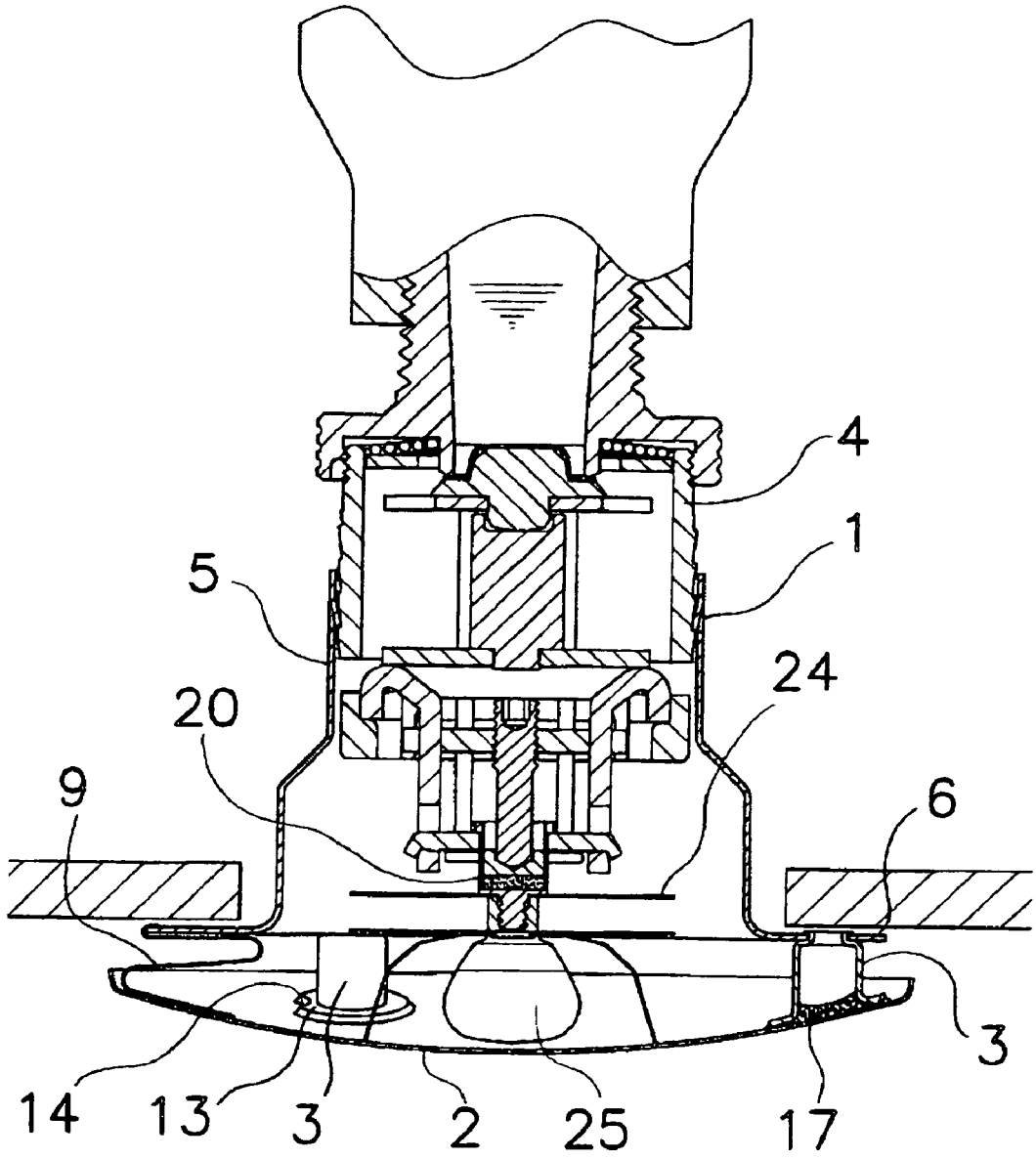
FIG. 1 is a sectional view of a sprinkler head cover and a sprinkler head of a first embodiment.
Figure 2:
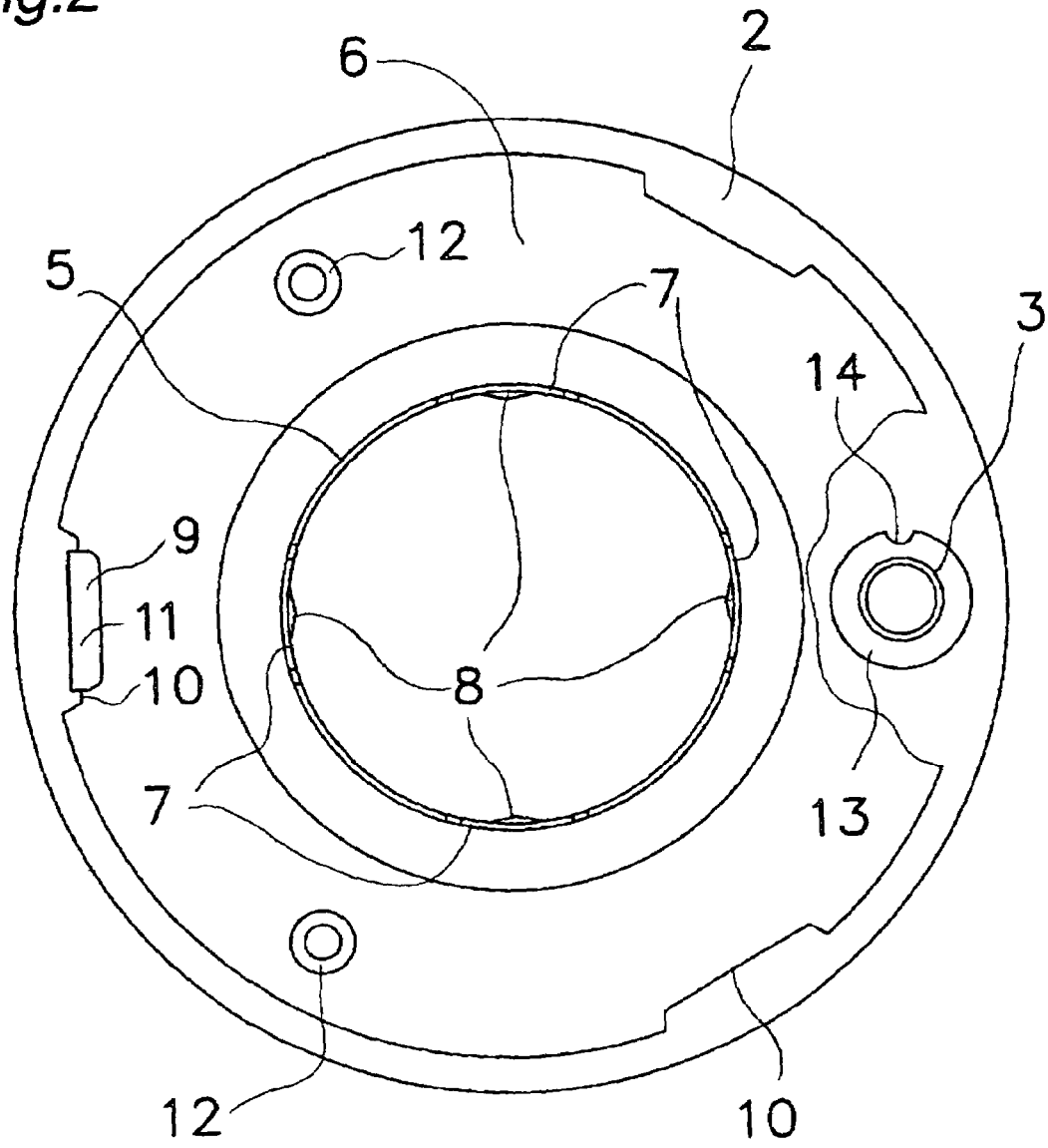
FIG. 2 is a plan view of a sprinkler head cover.
Figure 3:
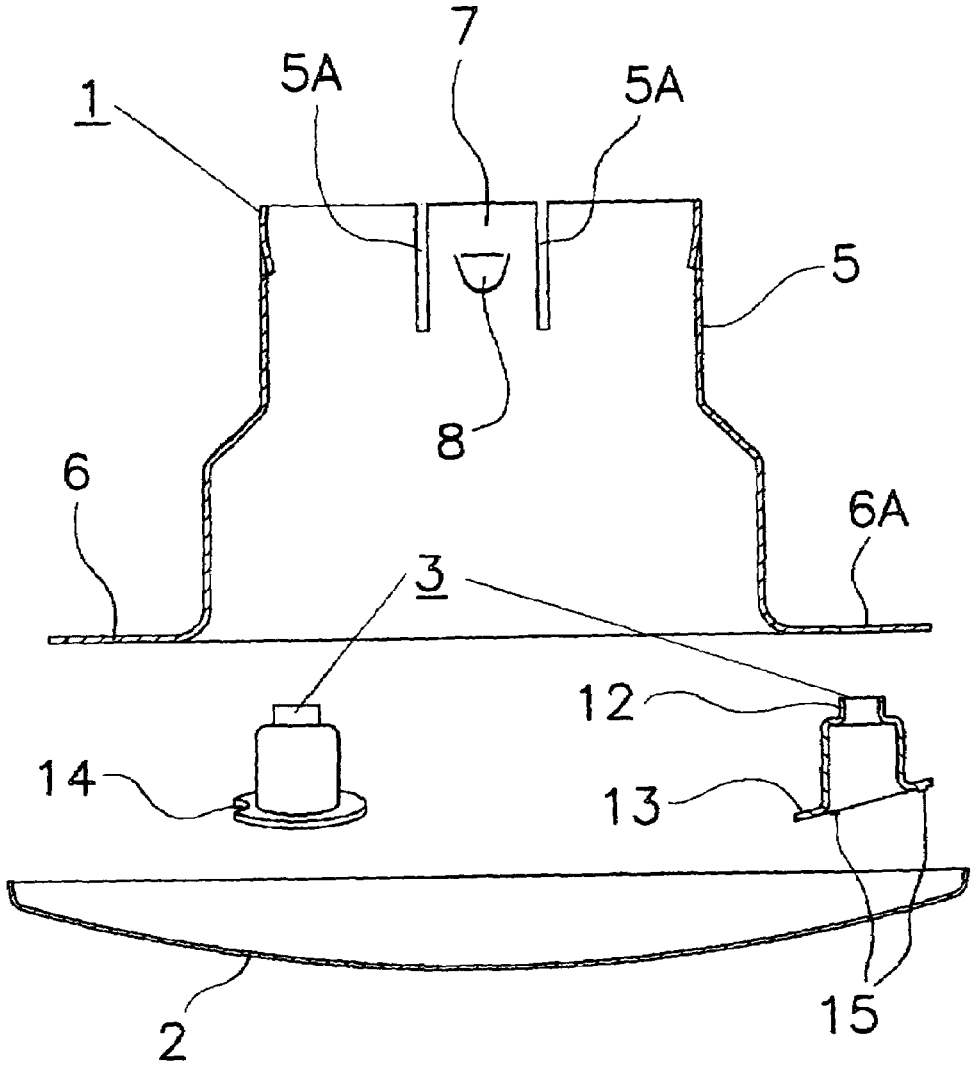
FIG. 3 is an exploded sectional view of a sprinkler head cover.
Figure 4:
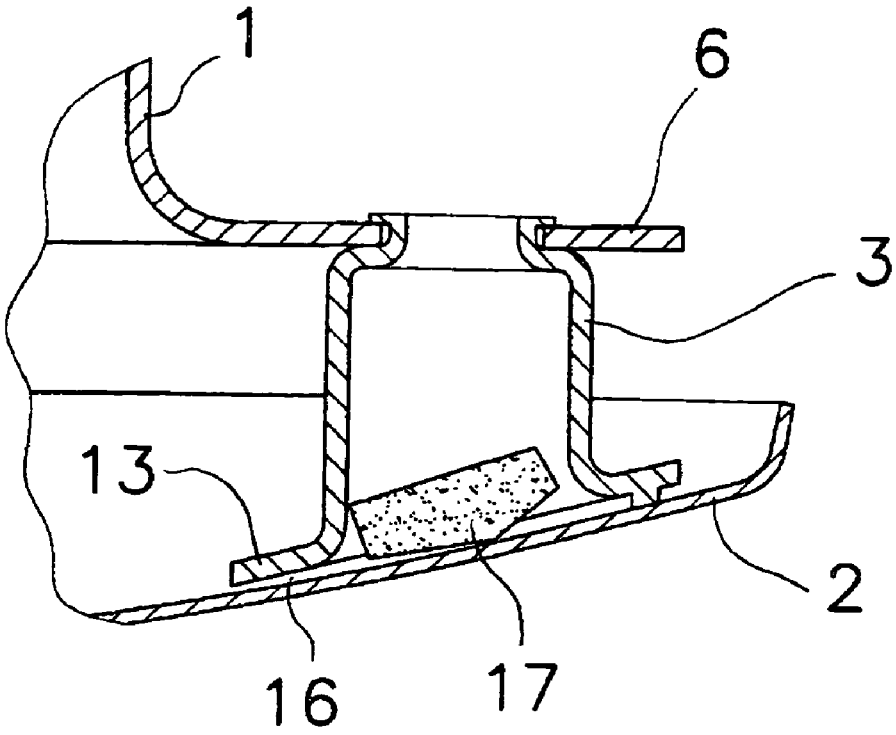
FIG. 4 is a sectional view of a cover plate and a mount before their having been connected to each other.
Figure 5:
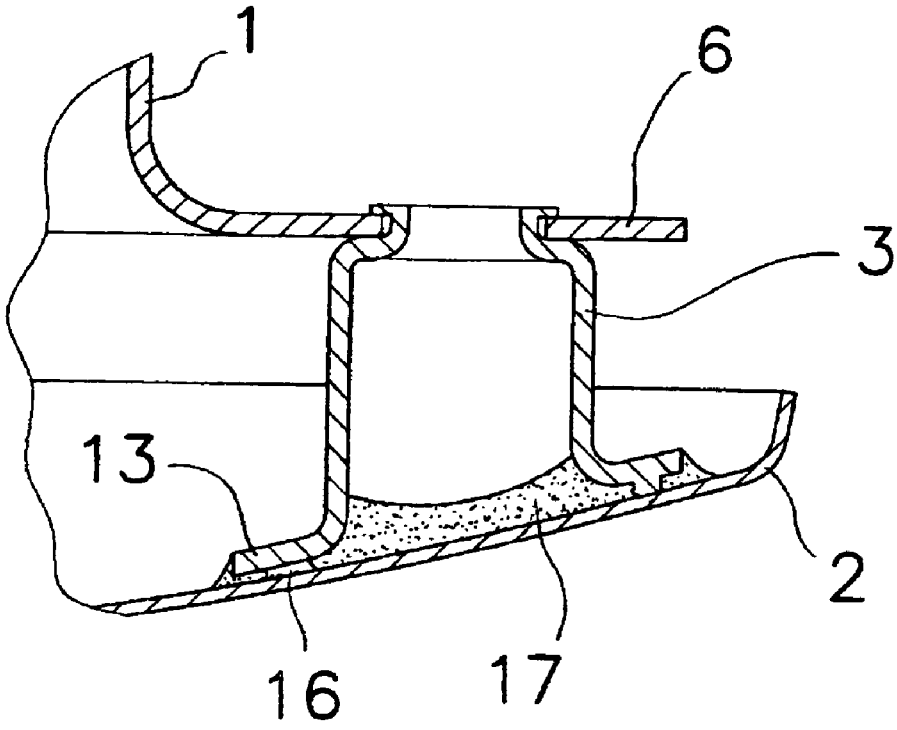
FIG. 5 is a sectional view of a cover plate and a mount after their having been connected to each other.
Figure 6:
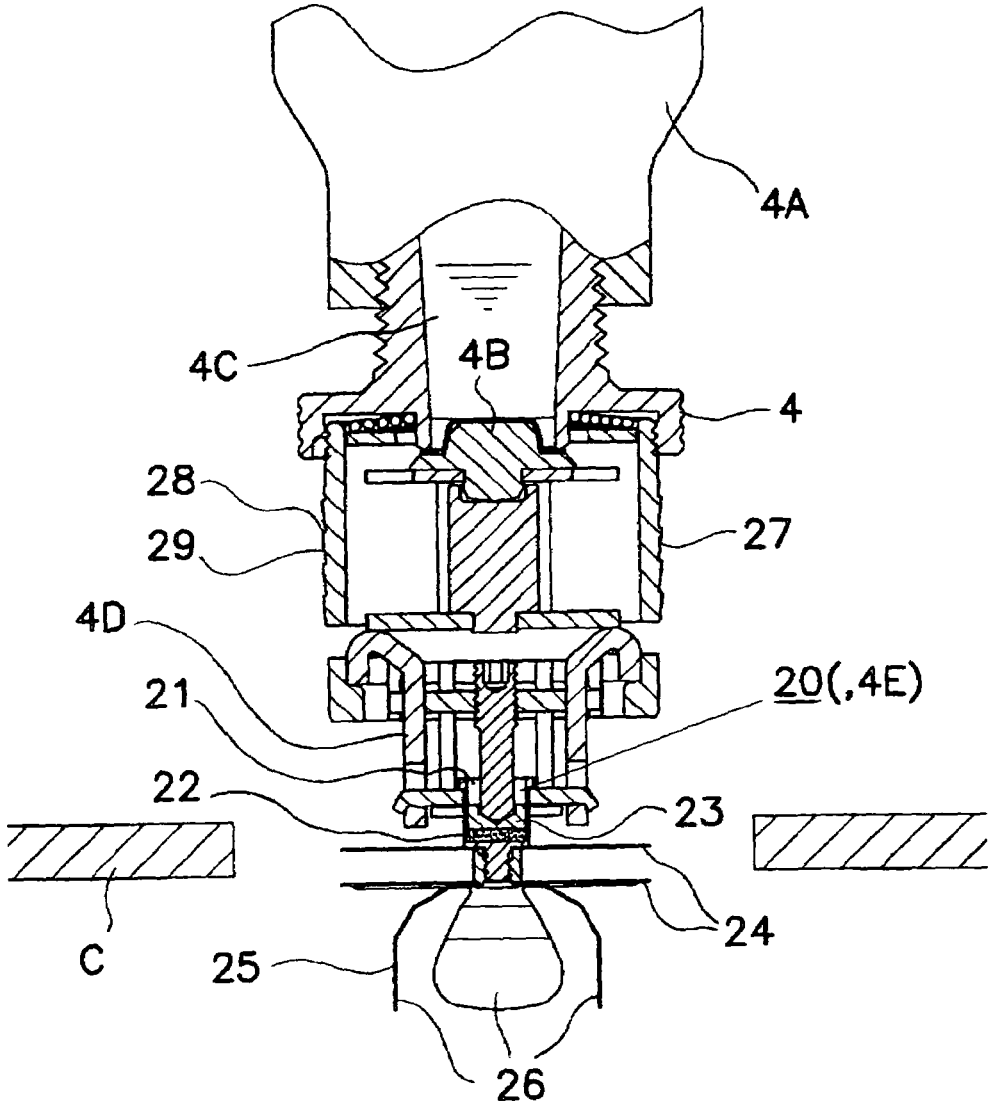
FIG. 6 is a sectional view of a sprinkler head.
Figure 7:
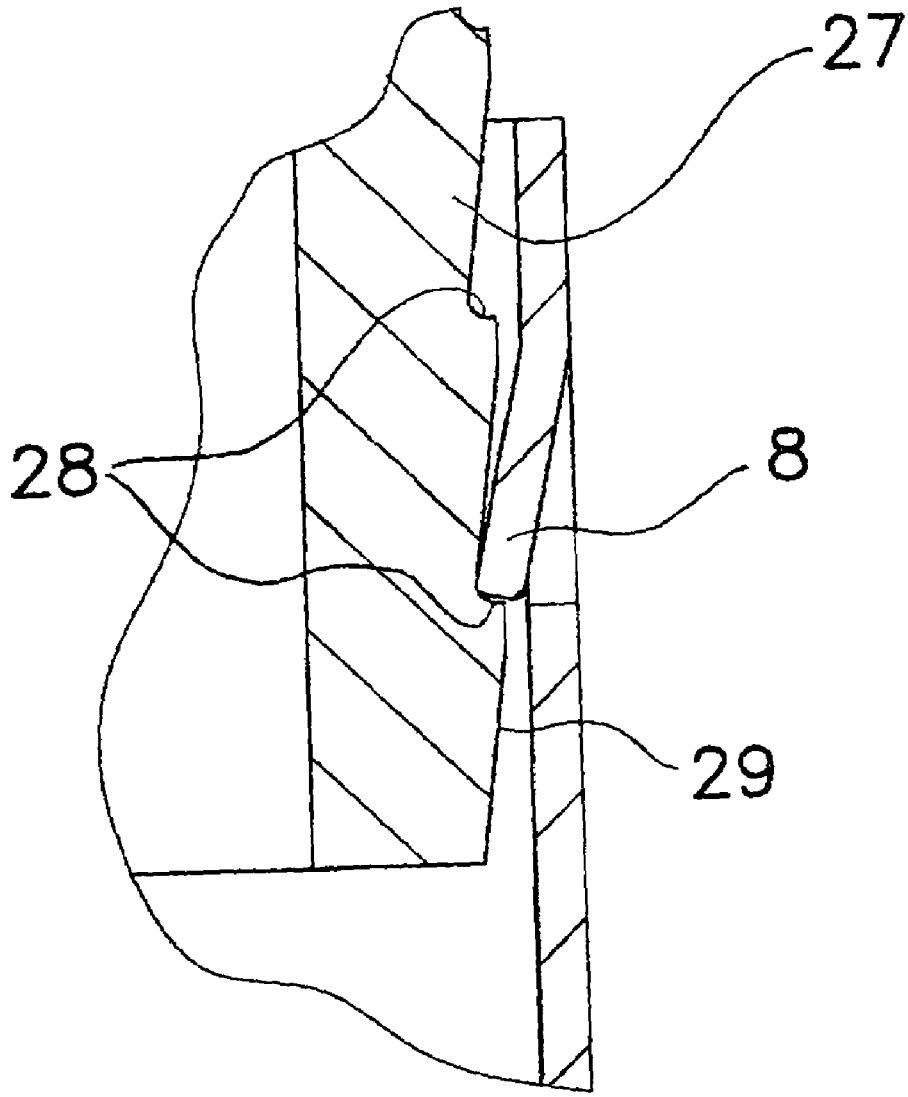
FIG. 7 is an enlarged sectional view of an engagement between a sprinkler head cover and a sprinkler head.
Figure 8:
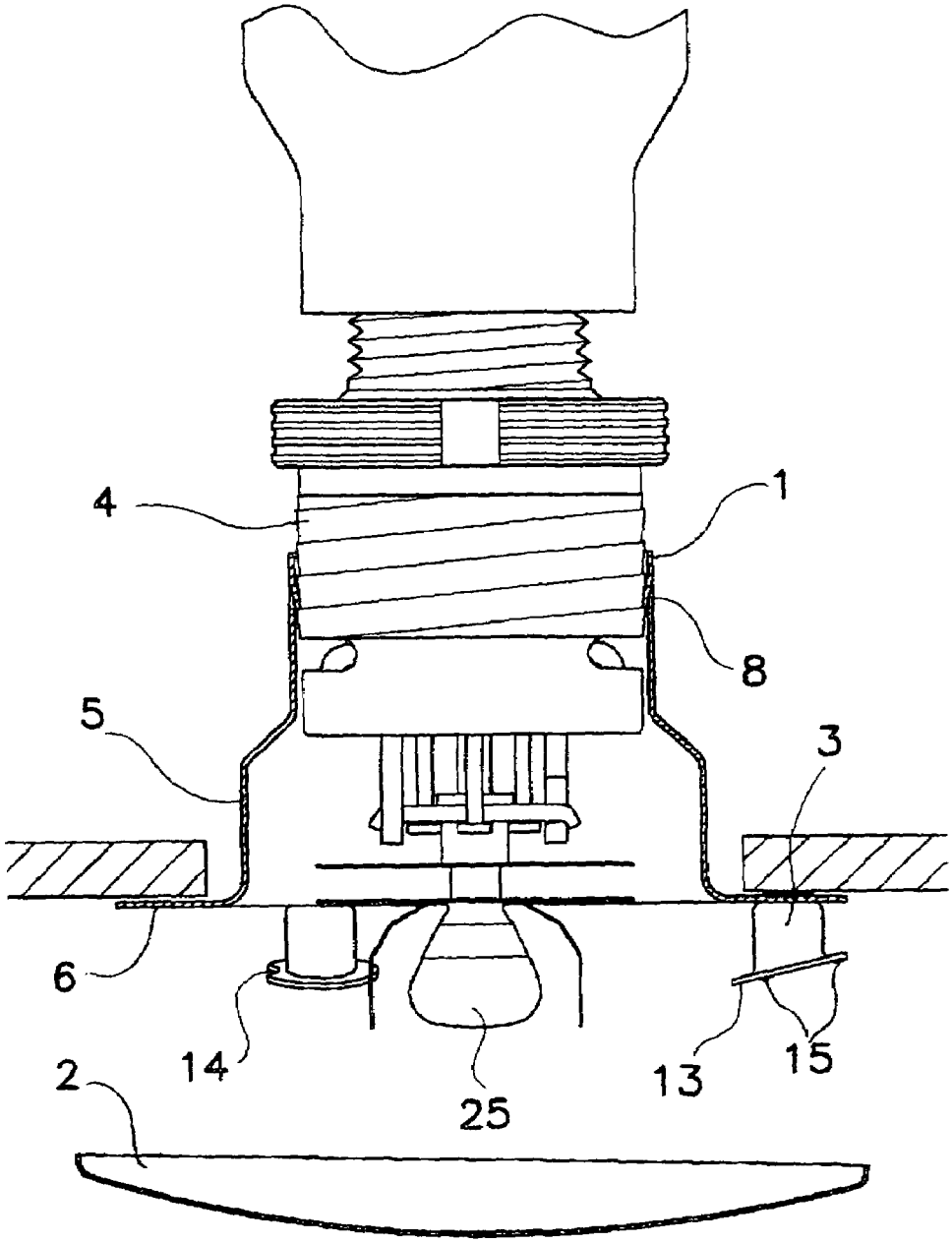
FIG. 8 shows a state when a cover plate has dropped off.
Figure 9:
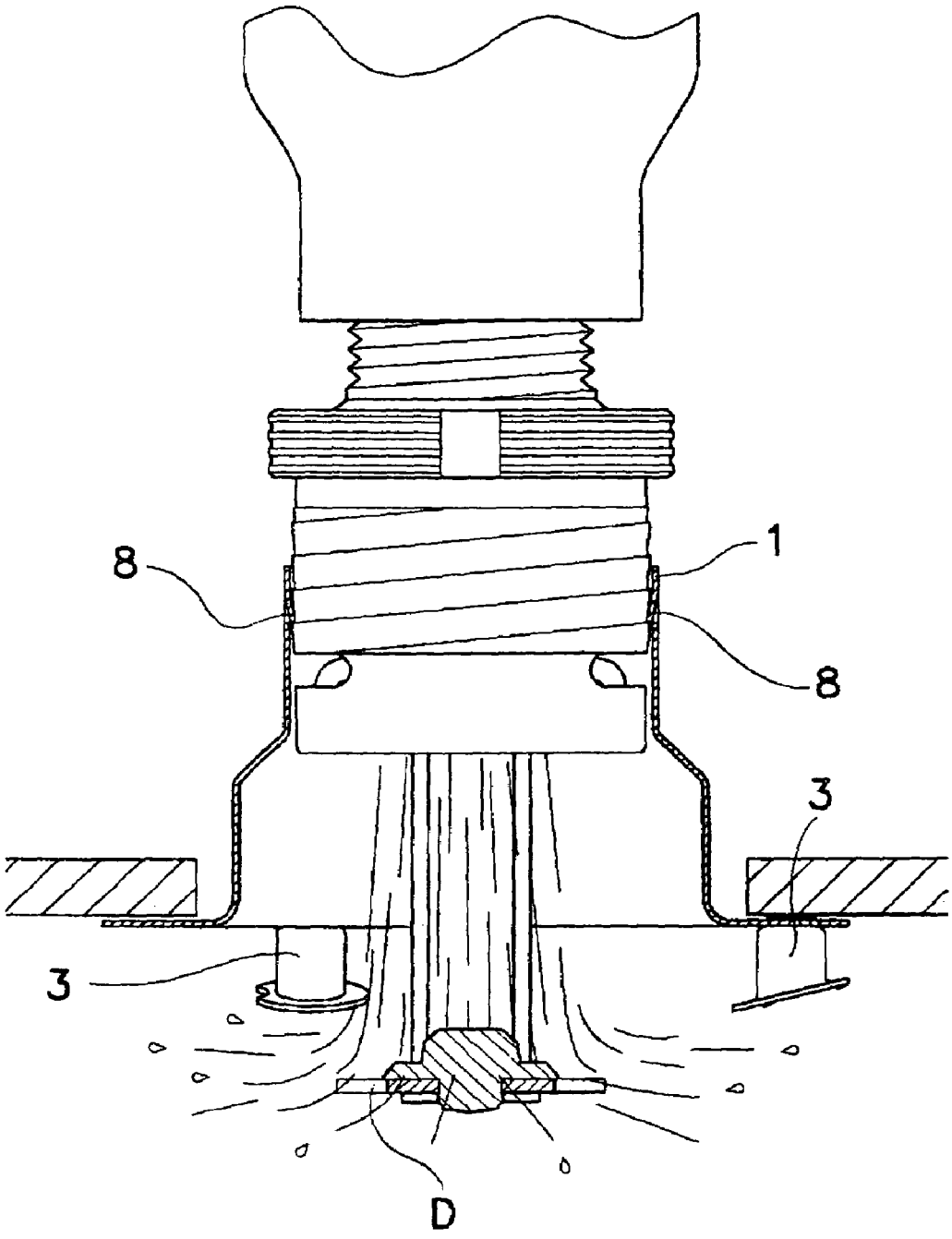
FIG. 9 shows a state when a sprinkler head has been actuated.

The first embodiment of the present invention will now be described with reference to FIGS. 1 to 7. FIG. 1 is a sectional view of a sprinkler head cover and a sprinkler head of the first embodiment. FIG. 2 is a plan view of the sprinkler head cover. FIG. 3 is an exploded sectional view of the sprinkler head cover. FIG. 4 is a sectional view of a cover plate and a mount before their having been connected to each other. FIG. 5 is a sectional view of the cover plate and the mount after their having been connected to each other. FIG. 6 is a sectional view of the sprinkler head. FIG. 7 is an enlarged sectional view of an engagement between the sprinkler head cover and the sprinkler head. FIG. 8 shows a state when the cover plate has dropped off; and FIG. 9 shows a state when the sprinkler head has been actuated.

The sprinkler head cover of the first embodiment, as shown in FIGS. 1 to 3, comprises a housing 1, a cover plate 2 and a mount 3 and the sprinkler head cover is attached to a sprinkler head 4.

The housing 1 is made of a heat insulating material having resilience, specifically a stainless material or a synthetic resin, or metal material coated with the heat insulating material. The housing comprises a cylindrical portion 5 and a flange 6 disposed at a lower end of the cylindrical portion 5 and extending outward therefrom.

The cylindrical portion 5 includes narrow movable surfaces 7, defined by a plurality of cuts 5A. The movable surface 7, which is separated from the cylindrical portion 5 by the cuts, can be elastically deformed outward and inward. A pawl 8 is disposed on the movable surface 7, which protrudes obliquely downward so as to engage with the sprinkler head 4.

The mount 3 is fitted in each of a plurality of holes 6A formed through the flange 6, such that the mount 3 is suspended from the flange 6.

A cut or cutout portion 10 is formed in a peripheral edge of the flange 6, which is to be engaged with a leaf spring 9 disposed between the flange 6 and the cover plate 2. The leaf spring 9 is made of resilient material that is folded in three and includes a pawl 11 formed in a side to be brought into contact with the flange 6.

If the leaf spring 9 is disposed between the flange 6 and the cover plate 3 with the pawl 11 being locked in one of the cuts 10, and the leaf spring 9 is locked in the cut with the aid of the pawl 11, this arrangement can prevent the leaf spring 9 from slipping inward and being disengaged from the cover plate 2 when it is subjected to an external force.

The cover plate 2 has a curved surface configuration with a raised peripheral edge. This peripheral edge that rises up can inhibit the leaf spring 9 from being removed from the position where it has been installed as described above.

Since the cover plate 2 has employed the curved surface configuration, a surface area of the cover plate 2 is larger than a cover plate employing a flat surface configuration, therefore this configuration allows the heat to be absorbed efficiently from a hot air stream drifting in a level below a ceiling surface. In addition, the curved surface configuration can further improve the strength of the cover plate 12 against an external force.

The mount 3 assumes generally a cylindrical configuration with its upper portion reduced to define a small diameter cylinder section 12. The small diameter cylinder section 12 is inserted into the hole 6A of the housing 1, and a portion protruding over the flange 6 is fixed to the housing 1 by a caulking process.

A lower portion of the mount 3 is formed into a flange 13, which is defined to be oblique relative to an axis of the cylinder section of the mount 3.

A notch 14 is formed in the flange 13, and the notch 14 is used to align the mount 3 with the housing 1 when they are connected to each other. The aligning with the use of the notch 14 is carried out for the purpose of achieving a connection of the mount 3 to the housing 1 in a position where an inclined-face of the flange 13 comes in surface contact with the cover plate 12.

An under surface of the flange 13 provides a surface to be connected with the cover plate 2, and a protrusion 15 is formed in the under surface of the flange 13. The protrusion 15 has the effect of providing a gap 16 between the flange 13 and the cover plate 2.

The gap 16 permits molten low melting point alloy 17 in the mount 3 to flow into the gap 16 under the capillary phenomenon during the connecting of the mount 3 with the cover plate 2 by using the molten low melting point alloy 17 (see FIG. 5).

The molten low melting point alloy 17 now present in the gap 16 can adhere to an outer peripheral surface of the flange 13 due to its surface tension, and if the molten low melting point alloy 17 is cooled, as in this condition, then the cover plate 2 and the mount 3 can be connected to each other, in which advantageously the connection is established not only between the bottom surface of the flange 13 and the cover plate 2 but also between the outer peripheral surface of the flange 13 and the cover plate 2 in a three-dimensional manner so as to provide a rigid connection between the mount 3 and the cover plate 2.

The sprinkler head 4, as shown in FIGS. 1 and 6, is connected with water supply piping 4A, and a nozzle 4C thereof is closed with a valve 4B within the sprinkler head. The valve 4B is supported by a heat sensitive operating section 4D and a heat sensitive element 4E is incorporated in the heat sensitive operating section 4D, so that in operation, the heat sensitive element 4E senses heat from a fire and triggers the heat sensitive operating section to be actuated for opening the valve.

Incidentally, most of the sprinkler heads can be categorized into two types: one having a structure of the heat sensitive element implemented by a glass valve; and the other having a structure of the heat sensitive element using a low melting point alloy. The heat sensitive element of the sprinkler head used in the present invention has employed the one using the low-melting point alloy whose structure is disclosed in the Japanese Patent Laid-open Publication No. Hei 07-284545.

It is to be noted that the explanation of an internal structure of the sprinkler head is omitted in the specification of the present invention.

The sprinkler head 4, as shown in FIG. 6, employs a configuration in which a cylinder 21 defining a circular cylindrical configuration having a bottom surface is filled with a low melting point alloy 22 serving as a heat sensitive element 20, and a plunger 23 is mounted on the low melting point alloy 22.

A few pieces of heat collectors 24, each having a disk-like configuration, are disposed in layers in an under side of the cylinder 21. The heat collector 24 is made of material, such as copper, copper alloy, aluminum or other material that is more apt to absorb the heat from fire for the purpose of transmitting the heat to the low melting point alloy 22 disposed within the cylinder 22.

A heat collector 25 is placed in a bottom layer of the plurality of heat collectors 24. Each heat collector 25 specifically has a plurality of vanes 26 extending radially.

The heat collector 25 is made of resilient material, such as a spring member, and has respective vanes 26 suspended in a diagonally downward direction.

When the housing 1 is attached to the sprinkler head 4, the inner wall of the cover plate 2 comes in contact with the heat collector 25 to place the vanes 26 in a position where they are expanded outward. Once the cover plate has dropped off, the heat collector 25, which is made of the resilient material, can be restored to an original position.

A saw tooth thread 27 is provided in an outer circumferential surface of the sprinkler head 4 for engagement with the housing 1. A cross-sectional geometry of a thread of the saw tooth threads is defined by an upper surface 28 forming a substantially horizontal plane and an inclined-face 29 extending downward obliquely from the horizontal plane.

A procedure for assembling the sprinkler head cover of the present invention will now be described.

First of all, the housing 1 is connected with the mount 3. The small diameter cylinder section 12 of each mount 3 is inserted into a corresponding one of a plurality of holes 6A formed through the flange 6 of the housing 1, and the notch 14 defined in the flange 13 of the mount 3 is aligned in position.

The small diameter cylinder section 12, with the notch having been aligned, is fixed to the flange 6 by caulking. As it is, the flange 13 of each mount 3 can be fixedly placed in an orientation for placing it in surface contact with the inner wall of the cover plate 2.

Subsequently, the flange 13 is mounted on the inner wall of the cover plate 2, and a piece of low melting point alloy 17 is introduced into the mount 3 (see FIG. 4). As it is heated in a furnace, the low melting point alloy 17 can melt with the aid of the heat inside the furnace so that the thus melted low melting point alloy 17, under the capillary phenomenon, can flow into the gap 16 between the mount 3 and the cover plate 2 (see FIG. 5).

During this step, the low melting point alloy 17 that has melted and flowed into the gap 16 between the mount 3 and the cover plate 2 tends to adhere to the outer peripheral surface of the flange 13 of the mount 3 due to its surface tension, so that the low melting point alloy 17 is now also present intermediately between the cover plate 2 and the outer peripheral surface of the flange 13.

When the housing 1 and the cover plate 2, in the condition as described above, are taken out of the furnace and cooled, the low melting point alloy 17 is solidified to accomplish the connection of the housing 1 with the cover plate 2. Finally, the leaf spring 9 is positioned such that the pawl 11 thereof is aligned with the cut 10 of the housing 1 for engagement therebetween, and then the leaf spring 9 is pushed inward until the under surface of the leaf spring 9 is accommodated in the inner side of the raised portion of the peripheral edge of the cover plate 2 to complete the sprinkler head cover.

A procedure for attaching the sprinkler head cover to the sprinkler head 4 as described above will now be described.

The sprinkler head 4 is connected with the piping 4A arranged in the ceiling and installed such that only the components thereof located in the lower side of the heat sensitive element 20 may protrude out from the ceiling surface C. The sprinkler head cover is fitted over the sprinkler head 4 by the cylindrical portion 5 of the housing 1. As shown in FIG. 7, this process brings the pawl 8 of the housing 1 into contact with the inclined-face 29 of the saw tooth thread 27 defined in the outer circumferential surface of the sprinkler head 4.

Since the cross-sectional geometry of the thread of the saw tooth thread 27 is defined by the upper surface 28 forming the substantially horizontal plane and the inclined-face 29 extending downward obliquely from the horizontal plane, as shown in FIG. 7, the pawl 8 and the movable surface 7 including the pawl 8 formed therein may be resiliently deformed outward following a slope of the inclined-face 29 so long as the pawl 8 is moved in an upward direction, so that the housing 1 can be moved upward without receiving resistance from the saw tooth thread.

The sprinkler head cover can be mounted on the sprinkler head 4 by pushing up the housing 1 to a level where the flange 6 of the housing 1 comes in contact with the ceiling surface C.

Due to its geometric configuration, the saw tooth thread allows the housing 1 to move toward the ceiling but inhibits its movement in the opposite direction. To remove the housing 1 from the sprinkler head, the housing 1 may be rotated around its own axis for disengagement from the saw tooth thread.

Subsequently, operations of the sprinkler head cover and the sprinkler head in case of fire will now be described.

In a normal operating condition, the cover plate 2 of the sprinkler head cover is in contact with the heat collector 25 of the sprinkler head, as shown in FIG. 1. In the event of fire, the air heated by heat from the fire moves upward and starts drifting below the ceiling surface.

The cover plate 2 absorbs the heat from the hot air stream and transfer the heat to the low melting point alloy 17 connected with the cover plate 2 and to the low melting point alloy 22 of the heat sensitive element 20 via the heat collector 25 of the sprinkler head 4.

Further, the hot air stream may also flow into the cover plate 2 through the gap between the flange 6 of the housing 1 and the cover plate 2, so that the heat collectors 24 and 25, as well as the mount 3, can also absorb the heat directly from the hot air stream.

The heat transferred from the cover plate 2 and the mount 3 to the low melting point alloy 17 would not transfer to the housing 1 made of heat insulating material but acts to melt the low melting point alloy 17.

Since the connection strength between the cover plate 2 and the mount 3 is weakened via the melting of the low melting point alloy 17 and the leaf spring 9 acts to facilitate the dropping off of the cover plate 2, accordingly the cover plate 2 drops off so as to expose the sprinkler head 4 disposed within the housing 1 (see FIG. 8).

Once the cover plate 2 has dropped off, the vane 26 of the heat collector 25 that has been in contact with the cover plate 2 is restored into its original configuration where the vane 26 protrudes downward diagonally.

The heat collectors 24 and 25 absorb the heat from the hot air stream below the ceiling surface and transfer the heat to the low melting point alloy 22 of the heat sensitive element 20 to thereby melt the low melting point alloy 22 and thus permits the plunger 23 to sink into the cylinder 21 to actuate the heat sensitive operating section.

The actuation of the heat sensitive operating section supporting the valve can cancel the support to the valve, so that the valve opens the nozzle for releasing the fire extinguishing liquid from the nozzle. In response to the release of the fire extinguishing liquid, a deflector D accommodated inside the sprinkler head is now protruded ahead of the nozzle to be held there, so that the fire extinguishing liquid released from the nozzle impinges upon the deflector D and flows in all directions to thereby mitigate or extinguish fire with the dispersed fire extinguishing liquid.

Embodiment 2

Figure 10:
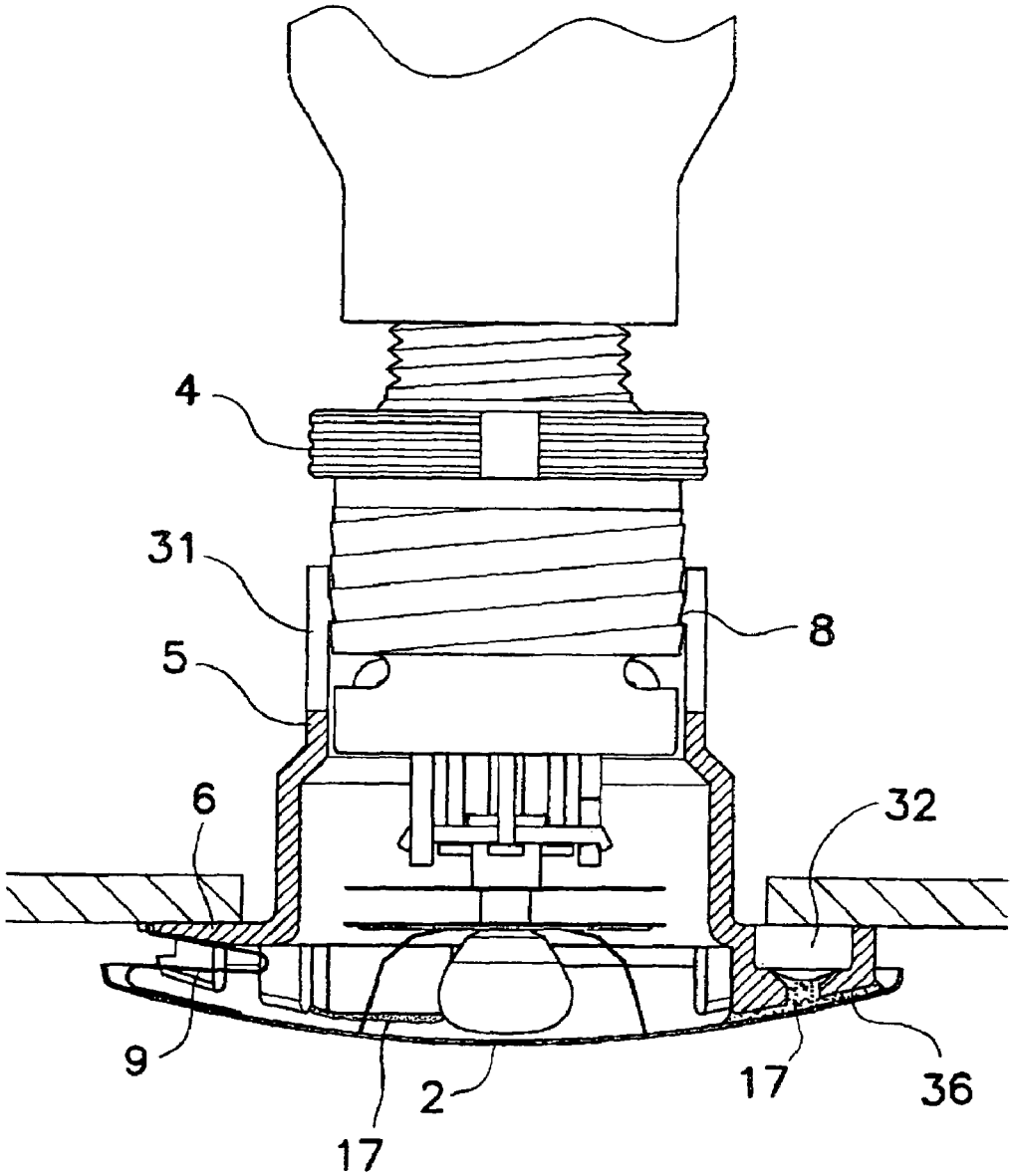
FIG. 10 is a sectional view of a sprinkler head cover and a sprinkler head of a second embodiment.
Figure 11:
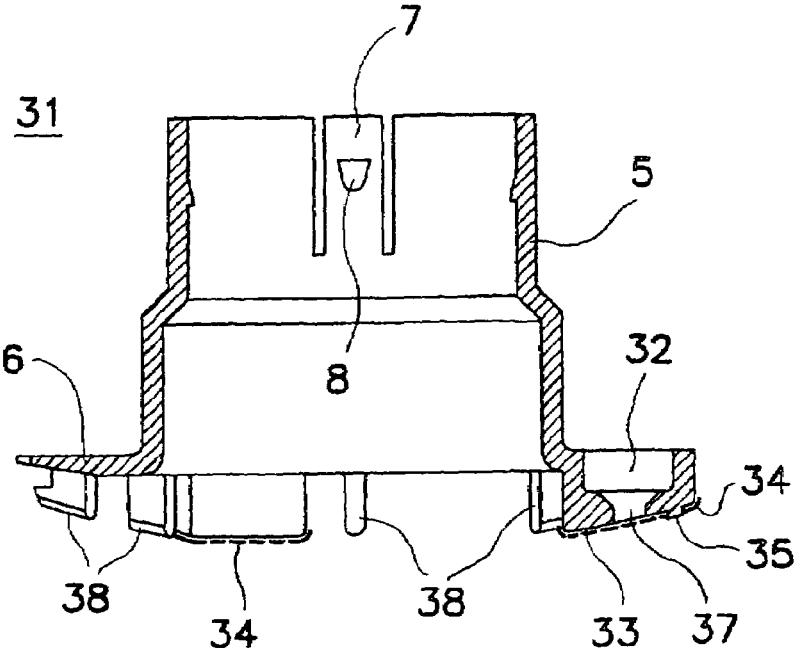
FIG. 11 is a sectional view of a housing of a second embodiment.
Figure 12:
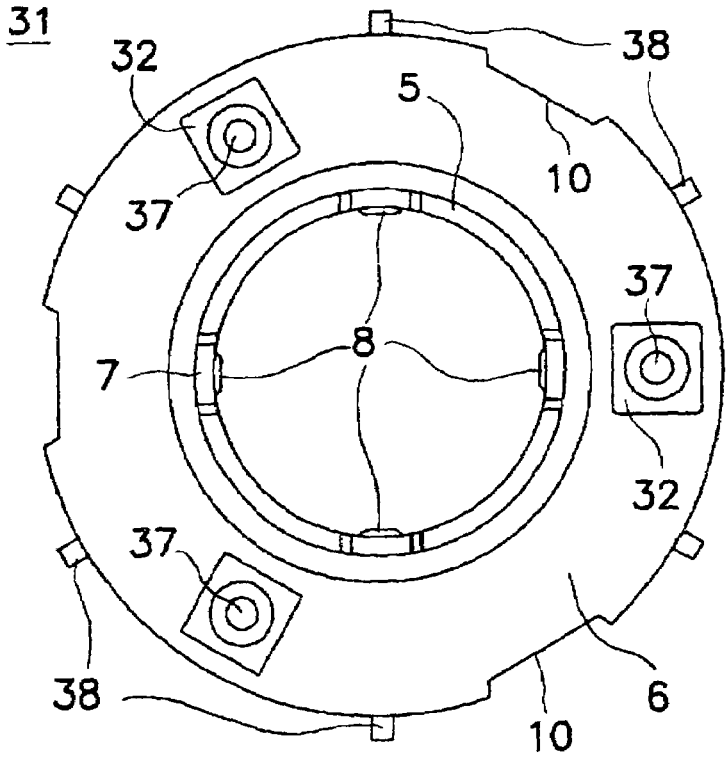
FIG. 12 is a plan view of a housing of a second embodiment.

Subsequently, a second embodiment will now be described with reference to FIGS. 10 to 12. FIG. 10 is a sectional view of a sprinkler head cover and a sprinkler head of the second embodiment while FIG. 11 is a sectional view of a housing of the second embodiment. FIG. 12 is a plan view of a housing of the second embodiment.

The sprinkler head cover of the second embodiment comprises a housing 31 and a cover plate 2, and the cover is adapted to be attached to the sprinkler head 4. It is to be noted that the cover plate 2 and the sprinkler head 4, as they have structures similar to those in the first embodiment, are designated with the same reference numerals and any detailed description thereof is omitted herein. In addition, as to the housing 31, as well, the components and portions having the same structures and functions as those in the first embodiment are designated with the same reference numerals and any detailed description thereof is omitted herein.

The housing 31 is made of heat insulating material such as, for example, stainless steel, synthetic resin and the like, and includes a cylindrical portion 5 and a flange 6 similar to the first embodiment. The cylindrical portion 5 is similar to that in the first embodiment, in which a movable surface 7 is defined and a pawl 8 is disposed on the movable surface 7 for engagement with the sprinkler head 4.

A cut 10 is formed in the flange 6, similar to the first embodiment, for engagement with a leaf spring 9 disposed between the flange 6 and the cover plate 2.

A plurality of recesses 32 is defined in the flange 6 for accommodating low melting point alloy 17 therein. A bottom surface 33 of each recess 32 provides a connecting surface to the cover plate 2, and a bottom surface 33 has an inclined-face or a curved surface configuration in conformity with an inner surface configuration of the cover plate 2.

The bottom surface 33 is applied with a coating film 34 made of suitable material providing good adhesion to the low melting point alloy in order to improve the connection strength to the cover plate 2 by means of the low melting point alloy 17. A specific material for the coating film 34 may include copper and tin, and such a material may be affixed, plated or applied to the bottom surface 33 to form the coating film 34. Alternatively, a material providing good adhesion to the low melting point alloy may be embedded in the bottom surface 33 for forming the coating film 34.

A small-size protrusion 35 protruding toward the cover plate side is disposed in the bottom surface 33. The protrusion 35 can secure a tiny gap 36 between the bottom surface 33 and the cover plate 2.

A small hole 37 is formed in the bottom surface 33, which extends from the recess 32 through the bottom surface 33, so that when the low melting point alloy 17 contained in the recess 32 is heated to melt, the molten low melting point alloy 17 under the capillary phenomenon flows from the small hole 37 into the gap 36 toward the cover plate side. Due to the surface tension, the molten low melting point alloy remains therein and is cooled so as to establish the connection between the bottom surface 33 and the cover plate 2.

A plurality of protrusions 38 is formed in a radial configuration in the surface of the flange 6 facing the cover plate 2. They are provided for the purpose of preventing the cover plate 2 from being deformed by an external force.

A procedure for assembling the sprinkler head cover of the second embodiment will now be described.

Firstly, a piece of low melting point alloy 17 is introduced in each recess 32 of the housing 31. Secondly, the bottom surface 33 of the housing 31 is mounted on the cover plate 2. In this condition, the gap 36 is defined between the bottom surface 33 and the cover plate 2 with the aid of the protrusion 35.

The cover plate 2 along with the housing 31 mounted thereon are introduced into a furnace and heated therein. The low melting point alloy 7 melts by the heat in the furnace and flows into the gap between the bottom surface 33 and the cover plate 2 under the capillary phenomenon.

As the housing 31 and the cover plate 2 are taken out of the furnace and cooled, the low melting point alloy 17 is solidified to establish the connection between the housing 31 and the cover plate 2. Finally, the leaf spring 9 is positioned such that the pawl 11 thereof may be aligned with the cut 10 of the housing 1 for the engagement therebetween, and then the leaf spring 9 is pushed inward until the under surface of the leaf spring 9 can be accommodated in the inner side of the raised portion of the peripheral edge of the cover plate 2 to complete the sprinkler head cover.

Since the sprinkler head cover of the second embodiment eliminates the work of installing the mount 3 in the housing 1, as required in the first embodiment, the sprinkler head cover can be manufactured at a lower cost.

Further, since the heat absorbed by the cover plate 2 would not transfer to the bottom surface 33 due to the housing 31 being made of the heat insulating material but can be consumed exclusively for melting the low melting point alloy 17, so that the heat can transfer to the low melting point alloy 17 efficiently to facilitate the melting effectively.

A procedure for attaching the sprinkler head cover to the sprinkler head 4 of the second embodiment 2, as well as an operation thereof in case of fire, are similar to those in the first embodiment, and so any detailed description is omitted herein.

The invention claimed is:

1. A sprinkler head cover comprising:

a housing adapted to be attached to a sprinkler head which is connected to a water supply piping and in which, in case of fire, a valve disposed inside said sprinkler head is opened to allow a fire-extinguishing liquid in the water supply piping to spread around;

a cover plate adapted to cover said sprinkler head so that said sprinkler head cannot be seen from outside; and a mount having a cylindrical configuration and having a hole extending therethrough, an upper portion of said mount being fixed to said housing and a lower portion of said mount being formed into a flange configuration defining a cover plate connecting surface, wherein a gap is defined between said flange configuration and an opposing surface of said cover plate, wherein a low melting point alloy is introduced into said hole of said mount, and wherein said cover plate and said mount are connected to each other by solidifying a molten low melting point alloy after said low melting point alloy is melted by heating and having flown out from said hole of said mount into the gap between said flange configuration and said cover plate.

2. A sprinkler head cover in accordance with claim 1, wherein said cover plate has a curved surface configuration and said cover plate connecting surface of said mount defines an inclined-face in contact with said curved surface of said cover plate.

3. A sprinkler head cover in accordance with claim 2, wherein a notch is formed in said cover plate connecting surface of said mount, and said notch serves as an aligning means when connecting said mount to said housing.

4. A sprinkler head cover in accordance with claim 1, further comprising a leaf spring folded in three and disposed between said housing and said of a curved surface of said cover plate, wherein a pawl is formed in an end of said leaf spring, and said pawl is locked in a cutout in a peripheral edge of said housing.

5. A sprinkler head assembly comprising:

a sprinkler head connectable to a water supply piping;

a heat sensitive element disposed in a lower portion of said sprinkler head;

a valve disposed in said sprinkler head, said valve being operable to allow a fire-extinguishing liquid in the water supply piping to be dispersed;

a housing attached to said sprinkler head;

a cover plate for covering said sprinkler head;

a mounting member having a cylindrical configuration and a hole extending therethrough, wherein an upper portion of said mounting member is fixed to said housing and a lower portion of said mounting member defines a flange forming a cover plate connecting surface, wherein a gap is defined between said flange of said mounting member and an opposing surface of said cover plate;

a heat collector connected to said heat sensitive element, said heat collector comprising a plurality of plate-like heat collector members disposed in layers, and a plurality of vanes protruding radially in a diagonally downward direction so as to contact said cover plate when said cover plate is connected to said housing via said mounting member, wherein one of said plate-like heat collector members, placed in a bottom layer of said plate-like heat collector members, is formed of resilient material; and a low melting point alloy inserted into said hole of said mounting member, wherein said cover plate and said mount are connected to each other by solidifying said molten low melting point alloy after said low melting point alloy is melted by heating and flown out from said hole of said mounting member into the gap between said flange of said mounting member and said cover plate.

* * * * *